US009468267B2

(12) United States Patent
Carleton-Raymond

(10) Patent No.: US 9,468,267 B2
(45) Date of Patent: Oct. 18, 2016

(54) CAP FOR BEADED JEWELRY

(71) Applicant: Cynthia Lee Carleton-Raymond, Santa Fe, NM (US)

(72) Inventor: Cynthia Lee Carleton-Raymond, Santa Fe, NM (US)

( * ) Notice: Subject to any disclaimer, the term of this patent is extended or adjusted under 35 U.S.C. 154(b) by 0 days.

(21) Appl. No.: 14/509,439

(22) Filed: Oct. 8, 2014

(65) Prior Publication Data

US 2016/0100656 A1 Apr. 14, 2016

(51) Int. Cl.

| | |
|---|---|
| ***A44C 5/02*** | (2006.01) |
| ***A44C 11/00*** | (2006.01) |
| ***A44C 25/00*** | (2006.01) |

(52) U.S. Cl.

CPC ..... *A44C 5/02* (2013.01); *A44C 11/002* (2013.01); *A44C 25/00* (2013.01)

(58) Field of Classification Search

CPC ..... A44C 5/02; A44C 5/10; A44C 5/185; A44C 13/00; A44C 11/00; A44C 25/00; A44C 17/02; A44C 17/0208; A44C 5/022; A44C 5/025; A44C 5/18; A44C 5/209; A44C 11/002

USPC ..... 63/35

See application file for complete search history.

(56) References Cited

U.S. PATENT DOCUMENTS 1,001,583 A * 8/1911 Fairbrother ..... A44C 17/02 63/26
1,031,401 A * 7/1912 Tirrill ..... 24/116 A
1,177,893 A * 4/1916 Payne ..... A44C 17/02 63/20
1,420,632 A * 6/1922 Kelly ..... A43C 9/06 24/715.6
1,578,940 A * 3/1926 Wacha ..... 24/116 A
1,646,999 A * 10/1927 Goodridge ..... 63/3
1,656,667 A * 1/1928 Finkenzeller ..... 24/116 A
1,660,460 A * 2/1928 Weiner ..... A44C 25/00 428/28
1,692,649 A * 11/1928 Goodridge et al. ..... 24/116 A
1,720,472 A * 7/1929 Gagnon ..... 24/116 A
1,740,992 A * 12/1929 McCretton ..... 59/93
1,840,681 A * 1/1932 Seidman ..... A44C 5/02 59/80
1,898,212 A * 2/1933 Polcini ..... 24/128
2,036,172 A * 3/1936 Gagnon ..... 24/116 A
2,069,598 A * 2/1937 Arpels ..... A44C 17/02 63/26
2,105,689 A * 1/1938 Freddino ..... 24/116 A
2,119,436 A * 5/1938 Lauff ..... 63/4
2,214,448 A * 9/1940 Belcher, Jr. ..... A44C 5/185 24/129 W
2,538,090 A * 1/1951 Ferragamo ..... A44C 5/02 403/305
3,120,042 A * 2/1964 Speranza et al. ..... 24/128
3,247,561 A * 4/1966 Speranza ..... 24/116 A
4,972,685 A * 11/1990 Poll ..... A44C 17/02 63/26
5,509,181 A * 4/1996 Yuuki et al. ..... 24/116 A
7,150,141 B1 * 12/2006 Greenway et al. ..... 59/1

* cited by examiner

*Primary Examiner* — Emily Morgan
(74) *Attorney, Agent, or Firm* — Plager Schack LLP

(57) ABSTRACT

Some embodiments of the present disclosure include a cap for beaded jewelry, wherein the cap grips around the jewelry without requiring an adhesive or holes to be drilled in the jewelry and provides a mechanism for the jewelry to be attached to a chain. The cap may include a hollow tube configured to accommodate a section of a piece of jewelry and a bezel wire comprising bezel wire prongs attached to a surface of the hollow tube proximate to a tube opening such that the bezel wire prongs extend past the tube opening and away from the top plate, wherein the bezel wire prongs are configured to crimp around the beads of the jewelry, securing the cap to the jewelry. The hollow tube may have a loop extending therefrom allowing the cap to be connected to a jewelry chain or adjacent cap.

4 Claims, 4 Drawing Sheets

CAP FOR BEADED JEWELRY

BACKGROUND

The embodiments herein relate generally to jewelry, and more particularly, to a cap for beaded jewelry.

Bead endings are required for beaded jewelry. However, for conventional bead endings, the artist is required to either string the supporting wire or filament into the end and tie it off or use an adhesive. Additionally, most end caps for jewelry do not actually grip and hold onto the piece.

Therefore, what is needed is a cap for beaded jewelry, wherein the cap grips around the jewelry without requiring an adhesive or holes to be drilled into the jewelry.

SUMMARY

Some embodiments of the present disclosure include a cap for beaded jewelry, wherein the cap grips around the jewelry without requiring an adhesive or holes to be drilled in the jewelry and provides a mechanism for the jewelry to be attached to a chain. The cap may include a hollow tube configured to accommodate a section of a piece of jewelry and a bezel wire comprising bezel wire prongs attached to a surface of the hollow tube proximate to a tube opening such that the bezel wire prongs extend past the tube opening and away from the top plate, wherein the bezel wire prongs are configured to crimp around the beads of the jewelry, securing the cap to the jewelry. The hollow tube may have a loop extending therefrom allowing the cap to be connected to a jewelry chain or adjacent cap.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
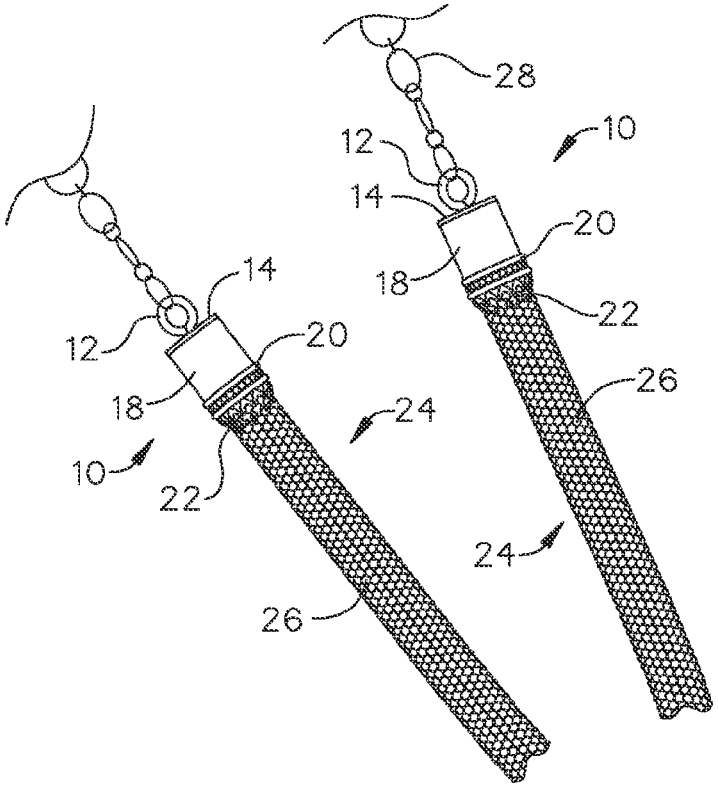
FIG. 1 is a perspective view of one embodiment of the present invention, shown in use.
Figure 2:
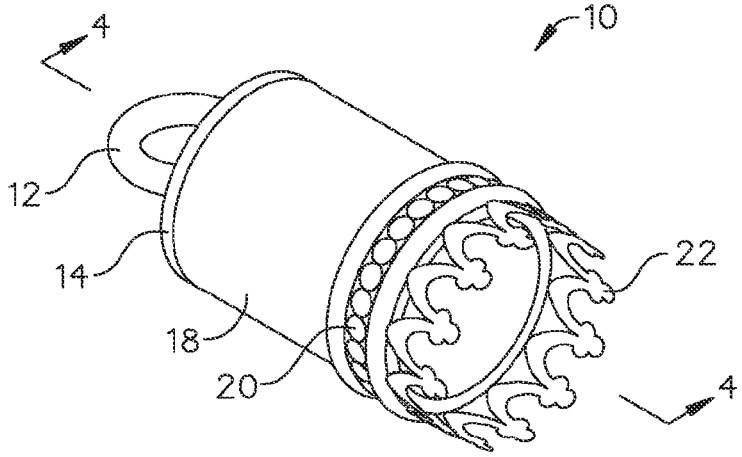
FIG. 2 is a perspective view of one embodiment of the present invention.
Figure 3:
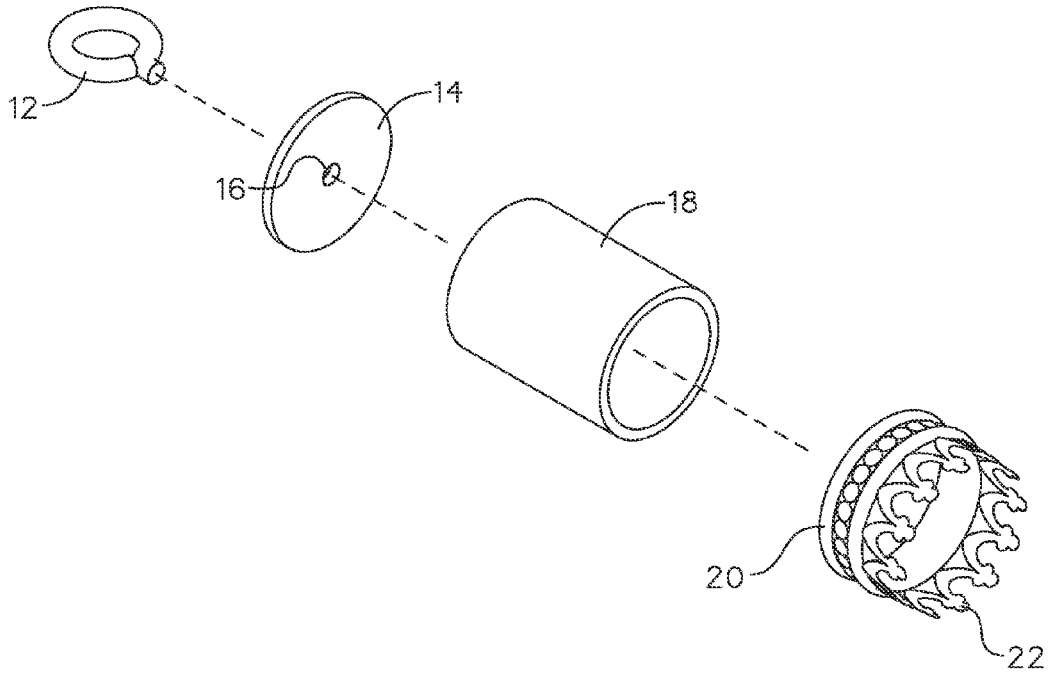
FIG. 3 is an exploded view of one embodiment of the present invention.
Figure 4:
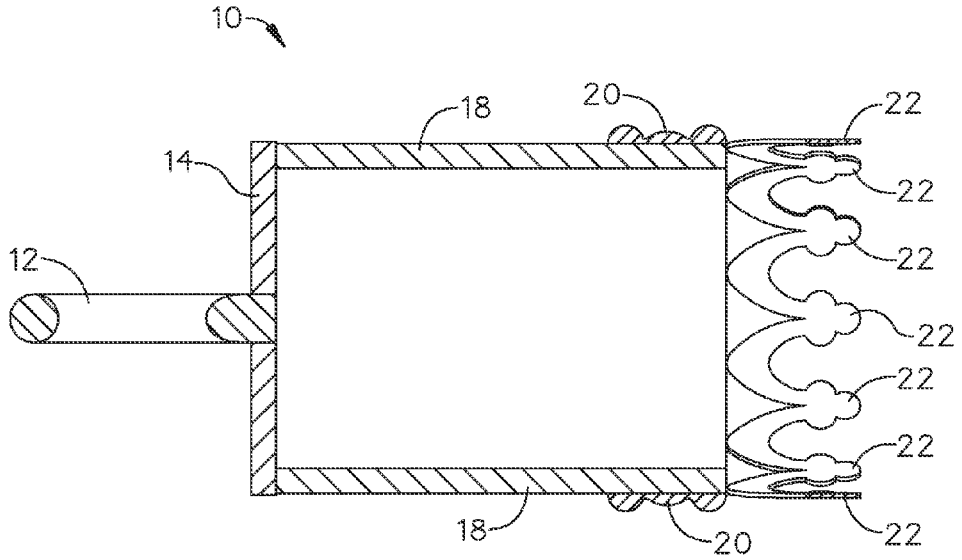
FIG. 4 is a section view of one embodiment of the present invention, taken along line 4-4 in FIG. 2.
Figure 5:
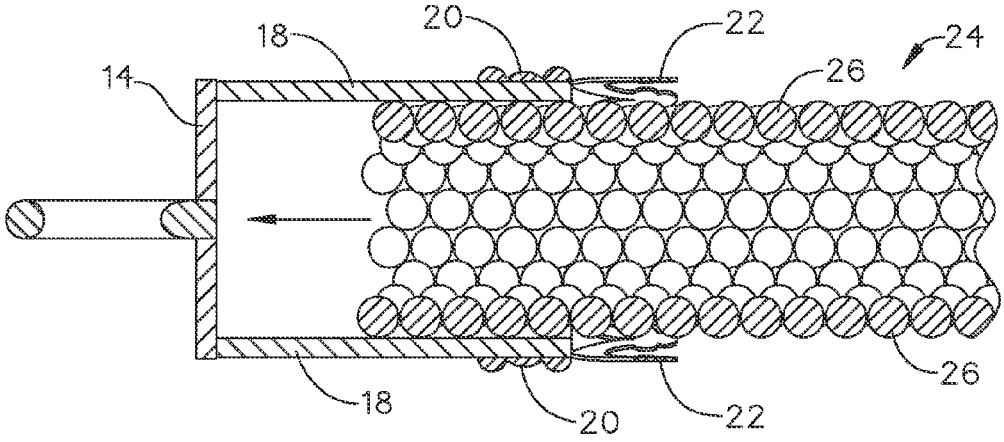
FIG. 5 is a section view of one embodiment of the invention, illustrating the insertion of a necklace 24 into the cap 10.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as an endcap for beaded jewelry and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Loop
2. Top Plate
3. Tube
4. Bezel Wire
5. Bezel Wire Prongs

The various elements of the cap for beaded jewelry of the present disclosure may be related in the following exemplary fashion. It is not intended to limit the scope or nature of the relationships between the various elements and the following examples are presented as illustrative examples only.

By way of example, and referring to FIGS. 1-7, some embodiments of the cap 10 for beaded jewelry of the present disclosure comprise a hollow tube 18 configured to accommodate a section of a piece of jewelry 24, such as a beaded necklace or bracelet, the hollow tube 18 having a top plate 14 and a tube opening opposite the top plate 14, the top plate 14 having a loop 12 extending outwardly therefrom, the loop 12 configured to attach to a jewelry chain 28, and a bezel wire 20 comprising bezel wire prong 22 attached to a surface of the hollow tube 18 proximate to the tube opening such that the bezel wire prongs 22 extend past the tube opening and away from the top plate 14, wherein the bezel wire prongs 22 are configured to crimp around the beads 26 of the jewelry 24. In some embodiments, the top plate 14 may comprise an orifice 16, wherein the orifice 16 is configured to accommodate an end surface of the loop 12, which may be soldered or otherwise attached in place. Alternatively, the top plate 14 and the loop 12 may be a single, integrated piece. Similarly, the bezel wire 20 may be soldered to an end of the tube 18 proximate to the tube opening or, alternatively, the bezel wire 20 and the tube 18 may be a single, integrated piece.

The tube 18 may have any desired shape and diameter and, in some embodiments, is substantially cylindrical as shown in the Figures such that a tubular piece of beaded jewelry 24, such as a tubular necklace or a tubular bracelet, is configured to fit therein, wherein the tube 18 may have a diameter slightly larger than the diameter of the beaded jewelry 24. In some embodiments, the tube 18 may have a length of about ⅜ inch. The top plate 14 may have a diameter substantially the same as or slightly larger than an outer diameter of the tube 18.

The loop 12 may comprise any suitable loop and, in some embodiments, comprises a loop made of 18 gauge wire, wherein the loop 12 is configured to engage with a necklace chain 28 or a closure component so that the jewelry 24 may be worn by a user. Thus, the tube 18 and loop 12 together may provide protection for the beads 26 on an end of the jewelry 24 placed within the tube 18 and may also provide a connection point configured to engage with the necklace or bracelet chain 28 with the closure component.

The bezel wire 20 may comprise any suitable wire having prongs 22 extending therefrom, wherein the prongs 22 are configured to engage with the beads 26 to secure the jewelry 24 in place. For example, the bezel wire 20 may comprise stamped gallery wire that is soldered into place with the prongs 22 extending outwardly from the tube 18, wherein the prongs 22 comprise a material capable of and configured to bend or crimp, as shown in FIG. 6, to engage with the beads 26 and secure the jewelry 24 in place.

Figure 6:
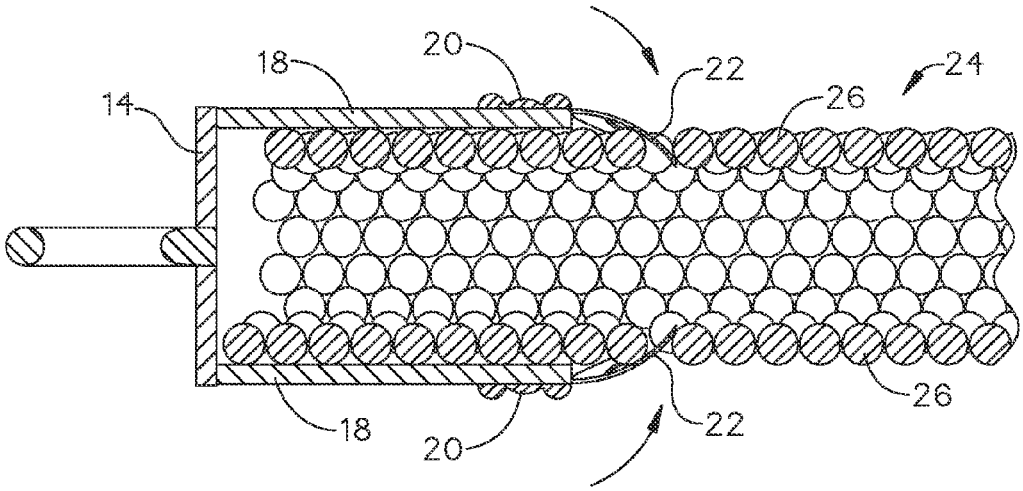
FIG. 6 is a section view of one embodiment of the present invention, illustrating the crimping of prongs 22 around beads 26.
Figure 7:
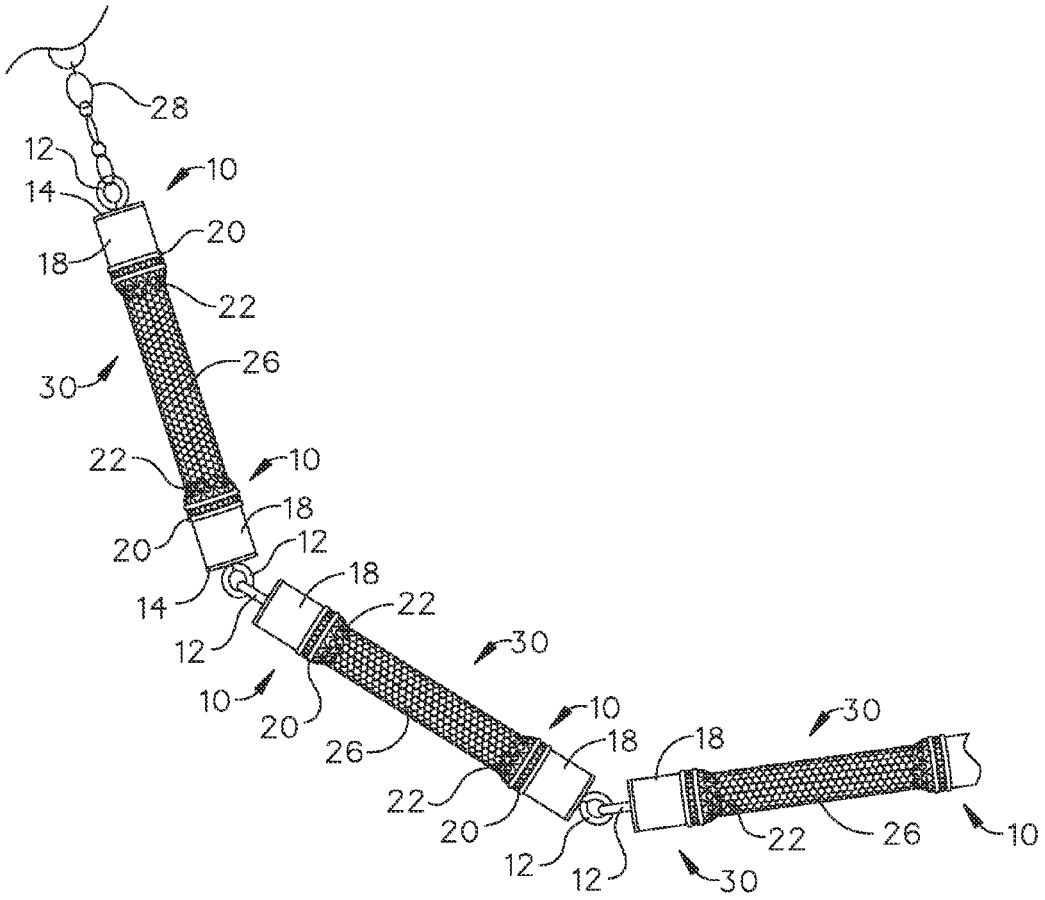
FIG. 7 is a perspective view of an alternate embodiment of the present invention.

To use the invention of the present disclosure, a user may insert the end of a beaded piece of jewelry 24 into the tube 18 and crimp the prongs 22 of the bezel wire 20 to engage with the beads 26, as shown in FIG. 6. The loop 12 may then be attached to chain 28 or, alternatively, to another loop 12, as shown in FIG. 7, creating a desired piece of jewelry.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A jewelry assembly, the jewelry assembly comprising:

a first cap, further comprising:

a first hollow tube having a first top plate and a first tube opening opposite the first top plate, the first top plate having a first loop extending outwardly therefrom; and a first bezel wire comprising first bezel wire prongs attached to a first surface of the hollow tube proximate to the first tube opening such that the first bezel wire prongs extend past the first tube opening and away from the first top plate, a second cap, further comprising:

a second hollow tube having a second top plate and a second tube opening opposite the second top plate, the second top plate having a second loop extending outwardly therefrom, the second loop is configured to attach to the first loop; and a second bezel wire comprising second bezel wire prongs attached to a second surface of the hollow tube proximate to the second tube opening such that the second bezel wire prongs extend past the second tube opening and away from the second top plate, a beaded jewelry, further comprising a plurality of parallel strands of spherical beads abutting at diameters with some spacing between the beads proximate the abutting diameters; wherein the first bezel wire prongs and the second bezel wire prongs are inserted into the spaces between some of the beads of the jewelry, securing the cap to the jewelry.

2. The jewelry assembly of claim 1, wherein the top plate comprises an orifice configured to accommodate an end surface of the loop therein; and the loop is joined to the top plate.

3. The jewelry assembly of claim 1, wherein the top plate and the loop comprise a single, integrated piece.

4. The jewelry assembly of claim 1, wherein the bezel wire is joined to the surface of the tube.

* * * * *